US012747585B2

(12) United States Patent
Platt et al.

(10) Patent No.: US 12,747,585 B2
(45) Date of Patent: Sep. 29, 2026

(54) WALL PANEL

(71) Applicant: EEKOWALL LIMITED, London (GB)

(72) Inventors: Derek Platt, London (GB); Michael Reilly, London (GB)

(73) Assignee: EEKOWALL LIMITED, London (GB)

( * ) Notice: Subject to any disclaimer, the term of this patent is extended or adjusted under 35 U.S.C. 154(b) by 221 days.

(21) Appl. No.: 18/394,346

(22) Filed: Dec. 22, 2023

(65) Prior Publication Data

US 2024/0125117 A1 Apr. 18, 2024

Related U.S. Application Data

(63) Continuation of application No. PCT/IB2022/055961, filed on Jun. 27, 2022.

(30) Foreign Application Priority Data

Jun. 25, 2021 (GB) ..... 2109232

(51) Int. Cl.
*E04B 2/74* (2006.01)
*E04C 2/38* (2006.01)

(52) U.S. Cl.
CPC ..... *E04B 2/7401* (2013.01); *E04C 2/384* (2013.01); *E04B 2002/7488* (2013.01)

(58) Field of Classification Search
CPC ..... E04B 2/7448; E04B 2002/7479; E04B 2002/7488; E04B 2002/7485; E04B 2/7411; E04B 1/6125; E04B 2/7401; E04C 2/384
See application file for complete search history.

(56) References Cited

U.S. PATENT DOCUMENTS 4,037,381 A * 7/1977 Charles ..... E04C 2/384 52/475.1
5,444,955 A 8/1995 Ou
(Continued)

FOREIGN PATENT DOCUMENTS

CH 610973 A5 5/1979
CN 112376747 A 2/2021
(Continued)

OTHER PUBLICATIONS

Search Report and Written Opinion for PCT/IB2022/055961 (10 pages). (Year: 2022).*
(Continued)

*Primary Examiner* — Rodney Mintz
(74) *Attorney, Agent, or Firm* — Secant IP, PLLC

(57) ABSTRACT

A prefabricated wall panel is described, said panel comprising: a rear board; a front board forming an internal face for a room, said front board spaced away from said rear board to form a cavity; and a first side stud and a second side stud, each side stud connected to the front and rear boards on opposing sides of the cavity; and a wireway disposed within the cavity, wherein the wireway runs substantially from a base of the wall panel to a top of the wall panel to allow services to pass through the panel, and wherein the wireway constrains cabling of the services therein; and wherein the first side stud comprises a male mating means and the second side stud comprises a female mating means such that the prefabricated wall panel can mate with an adjacent prefabricated wall panel to form a continuous internal wall surface.

12 Claims, 11 Drawing Sheets

(56) References Cited

U.S. PATENT DOCUMENTS

| | | | | |
|---|---|---|---|---|
| 6,158,178 | A | 12/2000 | Jeffers et al. | |
| 6,434,890 | B1 | 8/2002 | Konnerth | |
| 7,520,100 | B1 | 4/2009 | Herrman et al. | |
| 9,157,232 | B2 | 10/2015 | Stahl, Jr. | |
| 9,222,261 | B2 * | 12/2015 | Weeks | E04C 2/384 |
| 9,719,251 | B2 | 8/2017 | Gosling | |
| 10,364,572 | B2 * | 7/2019 | Collins | E04C 2/34 |
| 11,060,286 | B2 * | 7/2021 | Collins | E04C 2/322 |
| 12,385,250 | B2 | 8/2025 | Al-Haboobi | |
| 12,571,209 | B2 * | 3/2026 | Platt | E04B 1/6125 |
| 2009/0113820 | A1 * | 5/2009 | Deans | E04B 1/14 52/800.1 |
| 2012/0096785 | A1 * | 4/2012 | Weeks | E04B 1/08 700/98 |
| 2014/0360115 | A1 | 12/2014 | Stahl, Jr. | |
| 2015/0143763 | A1 | 5/2015 | Gosling | |
| 2017/0284095 | A1 * | 10/2017 | Collins | E04C 2/322 |
| 2019/0316354 | A1 * | 10/2019 | Collins | E04C 2/322 |
| 2020/0131761 | A1 * | 4/2020 | Markman | E04C 2/46 |
| 2023/0383535 | A1 | 11/2023 | Griechen et al. | |
| 2024/0125117 | A1 | 4/2024 | Platt et al. | |
| 2024/0125118 | A1 * | 4/2024 | Platt | E04B 1/6125 |
| 2024/0125119 | A1 | 4/2024 | Platt et al. | |
| 2024/0141640 | A1 | 5/2024 | Platt et al. | |
| 2024/0318428 | A1 | 9/2024 | Al-Haboobi | |
| 2025/0376845 | A1 * | 12/2025 | Al-Haboobi | E04C 2/52 |

FOREIGN PATENT DOCUMENTS

| | | | |
|---|---|---|---|
| CN | 216446249 | U | 5/2022 |
| WO | 9815697 | A1 | 4/1998 |
| WO | 2012024742 | A1 | 3/2012 |

OTHER PUBLICATIONS

Amendment filed by Applicant in counterpart European Application No. 22776981.7 (9 pages). (Year: 2024).

Search Report and Written Opinion for PCT/IB2022/055959 (8 pages). (Year: 2022).

* cited by examiner

WALL PANEL

CROSS REFERENCE TO RELATED APPLICATIONS

The present application is a continuation of PCT/IB2022/055961, filed Jun. 27, 2022, which claims the benefit of GB 2109232.5, filed Jun. 25, 2021, both of which are fully incorporated herein by reference.

FIELD OF THE INVENTION

The invention relates to improvements in wall panels, in particular to prefabricated wall panels for interlocking with adjacent wall panels to form a wall.

BACKGROUND

Modern Methods of Construction are typically focussed on prefabricated, modular systems that are then fixed together on site. Whilst some sectors of the construction industry have advanced in this area, internal partitions are significantly behind.

Such Panels can be installed much quicker on site with less labour. The fixing methods do not require skilled labour and panels will be manufactured offsite in factory conditions where quality can be managed easily This results in lower workforce presence on sites, with associated lower welfare and safety management risks and concerns as well as improving build programmes.

Whilst current prefabricated wall panels are known, these typically require labourers to position and hold the panels into position until they are secured into position. Furthermore, said panels can be heavy and bulky with associated health and safety risks.

Additionally, the wall panels typically do not come finished, and so they still require services connections, which typically involve an electrician or similar technician creating holes in the wall and feeding service cables from a source (typically mounted in or near the ceiling) to ground level service connections. However, it is easy to lose the service cables within the walls. Additionally, due to technicians working in tandem, this problem is exacerbated. Also, there is a risk of such cabling being damaged by subsequent installation.

Whilst there are some examples that use conduits fed into the cavity through chased out holes, these are a post installation solution to preventing snagging of the cable, and furthermore tend to be fairly small (not much bigger than the cabling used) and can therefore be difficult to align or to find if they were pre-installed.

Additionally, existing solutions can reduce the thermal and/or acoustic integrity or efficiency of a panel.

Furthermore, such prefabricated panels are either bespoke, or still require interconnecting and securing to a floor when on site. This can delay service installation as the walls are not stable until they are secured.

It is an object of the present invention to at least ameliorate the above defined issues with the existing prior art.

SUMMARY OF THE INVENTION

According to a first aspect of the present invention there is provided a prefabricated wall panel comprising: a rear board; a front board forming an internal face for a room, said front board spaced away from said rear board to form a cavity; and a first side stud and a second side stud, each side stud connected to the front and rear boards on opposing sides of the cavity; and a wireway disposed within the cavity, wherein the wireway runs substantially from a base of the wall panel to a top of the wall panel to allow services to pass through the panel, and wherein the wireway constrains cabling of the services therein; and wherein the first side stud comprises a male mating means and the second side stud comprises a female mating means such that the prefabricated wall panel can mate with an adjacent prefabricated wall panel to form a continuous internal wall surface.

The present invention can allow for an internal wall to be erected quickly and services installed without needing to undertake additional stabilisation work. Instead, panels interlock via said mating means which secure the panels to existing fully secured panels allowing a service technician to install service cabling with minimum delay. Additionally, the use of a wireway to constrain the service cabling further speeds up installation of services.

Typically the wireway may comprise one or more channels that run substantially through the wireway. The use of multiple channels or passages allow separate channels to be used for different services. This aids installation and minimises the risk of damage to existing services on installation of subsequent ones.

The wireway describes a defined passage or channel through which service cabling can be fed through the cavity within the wall panel. The use of a wireway prevents the cabling from being lost within the wall panel and makes feeding cabling through the wall panel easier. In particular, the channels of the wireway ensure that cabling is constrained within a defined width of the panel. The wireway describes a defined passage or channel through which service cabling can be fed through the cavity within the wall panel. The use of a wireway prevents the cabling from being lost within the wall panel and makes feeding cabling through the wall panel easier. In particular, the channels of the wireway ensure that cabling is constrained within a defined width of the panel. The wireway can be accessed by either chasing out the desired portions of the front board to access a channel of the wireway behind, or by using defined openings. Given the positions of the channels are known prior to chasing out, a service technician can locate the wireway position such that cabling is installed within a channel.

In embodiments more than one channel may be provided, each channel may be spaced along a width of the front board to provide multiple positions for the service technician to install the service and to feed the required cabling. This gives versatility to the service technician and can also allow for multiple services to be installed side by side in separate channels, which may be adjacent to each other, without risk of the cabling from service interfering or entangling with another service cabling.

The services are typically power, with electrical cabling fed from a high level to a backbox installed at a lower point in the panel, or data that can be installed in a similar manner.

By prefabricating the wall panels, the panels can be manufactured off-site, with the wireway allowing a services technician to install services cabling efficiently and easily at a later time. Additionally, said technicians can be more confident that installation of services will not interfere with existing services within the wall, allowing, for example, networking servicing cabling to be installed away from electrical cabling due to the use of multiple channels within the wireway.

Typically in an embodiment the panel may further comprises: two side studs, each side stud connected to the front and rear boards, which are typically gypsum based boards, on opposing sides of the cavity; and one or more steel support rails connected across said side studs and between the rear boardboard and the wireway for supporting the wireway.

The side studs may comprise a framework, such as a metal frame, that attaches to the front and back boards. This framework acts to provide separation between the boards to provide the cavity therebetween. The framework can also be used to secure the wireway either directly or through the use of support structures such as support rails.

The use of support rails provide structural support for the wireway and also provide structures to which services backboxes can be affixed. The side studs may comprise a plurality of tabs, said tabs extendable away from the side studs into the void and providing a fixing point for the support rails. Typically the side studs comprise a metal profile, and the tabs are punched into the profile. This allows multiple tabs to be provided, which in turn allows the support rails to be supported at varying heights relative to the front board of the wall panel. In embodiments where the tabs are punched into the metal profile, the tabs may be configured to fold away from the profile to provide the fixing point.

In some embodiments the panel may further comprise a backbox secured to one of the support rails in a cutaway through the front board and the wireway. Said backboxes provide outlets for services and are connected to said service supply. Typically the backbox is secured in a cutaway that is located within a (single) channel of the wireway such that cabling can be fed within said channel during connection of the services.

In an embodiment the wireway may be made of cardboard. This allows for low cost and light weight, whilst also providing enough strength to prevent the wires from punching through said wireway and into either neighbouring channels or into the void. Furthermore, the use of cardboard can allow for a smooth surface to deflect the cabling as it is passed through the channel.

Generally the wireway runs part of the length of the wall panel rather than for the entire length of the panel. This both reduces material use and weight, as well as cost, and can provide a floor to the wireway such that cabling cannot be advanced too far through the channels.

The front board may further comprise a service access panel coupled to a top portion of the front board, said service access panel providing an opening through which cabling of services can be fed through the panel.

The panel may further comprise pattress plates disposed between the wireway and the front board, said pattress plates for supporting structural wall mounted fixtures and fittings.

The front board may be a gypsum based board, such as a plasterboard or the like. The rear board may also be a gypsum based board such that the wall panel can be used as an internal wall in a room, with both the front board and the rear board forming an internal face for a room. It can be appreciated that whilst shown as aligned back to back the front and back boards may not necessarily be aligned parallel to each other. For example, the back board may comprise two perpendicular boards aligned perpendicular to each other, with the front board forming the hypotenuse. This arrangement may be useful in room corners or when arranging the panel in front of existing wall structures.

In some embodiments the back board is not a gypsum based board, but is instead a lightweight material, such as cardboard. This can be useful if the back board is not intended for forming an internal face for a room. One example where this occurs is in a party wall structure. In such examples the panel may be considered to be a party wall panel.

It can be appreciated that two panels may be placed adjacent to each other with the front boards facing outwardly to form a sandwich structure. This sandwich structure may be used for party walls that separate rooms between different houses, apartments or the like. When used for party walls, it can be appreciated that the back board need not be gypsum and so is typically cardboard or the like as described above. Wireways may be provided on both panels that make up the party wall such that each service runs through a single panel to supply different dwellings. In this manner, the central cavity between panels that form the party wall can be kept clear of cabling making maintenance for a single dwelling easier and eliminating the risk of service cabling for adjacent dwellings becoming entangled.

According to a second aspect of the present invention there is provided a prefabricated wall system for creating internal building walls, said system comprising: one or more panels according to any embodiment of the first aspect; and a guide rail provided on a floor of a building, wherein said guide rail comprises a raised profile configured to be received within a correspondingly shaped recessed portion in a base track of the panel.

The system as described provides a method of installing an internal wall using prefabricated wall panels that are easier to install than existing traditional internal walls that are generally constructed on site. The use of male and female mating means between wall panels allows for a precise finish that results in a substantially smooth wall surface. The guide rail allows panels to be installed precisely and to form a straight wall and prevents small curvatures that can arise when flat wall panels are co-aligned. The guide rail acts to receive the panels and hold them substantially in position such that the panel is self-supporting. This allows an adjacent wall panel to be installed without having to fully secure the first panel.

The raised portion may comprise a substantially frusto-conical cross-section, said raised portion provided along the length of the guide rail. Accordingly the recessed portion has substantially the same cross-section (but with a negative cross-sectional profile so that it can receive the raised portion). The recessed portion may also extend less than the height of the raised portion, such that a gap is formed between the wall panel and the floor when the recessed portion receives the raised portion. Insulation may then be placed within the gap and/or flexible sealing to maintain acoustic and fire resistant performance.

Generally the side studs and the tracks may comprise metal framework to form a rigid frame for the panel. Stainless steel or aluminium is typically used to provide rigidity whilst also minimising weight.

A deflection profile may be used, located on a soffit above any provided guide rail, and wherein the panel is secured against the deflection panel. Deflection profiles are fixed to the soffit above which hold the panel in position whilst allowing for deflection in the building and maintaining performance.

In a further embodiment, multiple panels are provided, each panel secured to an adjacent panel via the mating means and received in the guide rail to form an internal wall.

The front board may be a gypsum based board, such as a plasterboard or the like. The rear board may also be a gypsum based board such that the wall panel can be used as an internal wall in a room, with both the front board and the rear board forming an internal face for a room. It can be appreciated that whilst shown as aligned back to back the front and back boards may not necessarily be aligned parallel to each other. For example, the back board may comprise two perpendicular boards aligned perpendicular to each other, with the front board forming the hypotenuse. This arrangement may be useful in room corners or when arranging the panel in front of existing wall structures.

In some embodiments the back board is not a gypsum based board, but is instead a lightweight material, such as cardboard liner board. This can be useful if the back board is not intended for forming an internal face for a room. One example where this occurs is in a party wall structure. In such examples the panel may be considered to be a party wall panel.

It can be appreciated that two panels may be placed adjacent to each other with the front boards facing outwardly to form a sandwich structure. This sandwich structure may be used for party walls that separate rooms between different houses, apartments or the like. When used for party walls, it can be appreciated that the back board need not be gypsum and so is typically cardboard or the like as described above. Wireways may be provided on both panels that make up the party wall such that each service runs through a single panel to supply different dwellings. In this manner, the central cavity between panels that form the party wall can be kept clear of cabling making maintenance for a single dwelling easier and eliminating the risk of service cabling for adjacent dwellings becoming entangled.

First and second party wall panels may be arranged parallel to each other on separate guide rails to form a party wall. In such embodiments an insulated sheet may be provided between the guiderails to lie between the first wall panel and the second wall panel in a void of the party wall between the rear boards.

The first wall panel and the second wall panel may be separated by a central deflection profile to brace the panels. Additionally or alternatively, each wall panel may be secured to a soffit using a deflection profile. Intumescent fire sealant may be provided between the deflection profile and the soffit.

According to a third aspect of the present invention there is provided a method for installing services in a prefabricated wall panel, said method comprising the steps of: forming a wall comprising at least two wall panels according to any embodiment of the first aspect, said wall panels mated together to form a unitary wall; creating an cutaway through said front board of at least one of said panels to access the wireway therein, said cutaway located solely within the wireway; installing a backbox within said cutaway; and feeding services cabling through the one channel to the backbox through the or an opening in a top portion of the front board.

According to a fourth aspect of the present invention there is provided a method for installing a wall with services, said method comprising the steps of: installing a guide rail on a floor beneath the intended wall position, said guide rail comprising a raised profile extending away from the floor; providing a first wall panels from a plurality of wall panels, each wall panel comprising: a rear board; a front board forming an internal face of the wall, said front board spaced away from said rear board to form a cavity; and a first side stud and a second side stud, each side stud connected to the front and rear boards on opposing sides of the cavity; and a head track and a base track, each track connected to the of the front and rear boardboard and the first and second side stud at a top and bottom of said panels and studs respectively; aligning a recessed profile in the base track of the first wall panel on the raised profile, wherein the raised profile has a substantially identical negative cross-section to the raised profile; aligning a second wall panel on the guide rail adjacent to said first wall panel, wherein a male mating means on the first side stud of one wall panel with a female mating means on the second side stud of the other wall panel; and installing services according to the third aspect.

According to a fifth aspect of the present invention there is provided a method of installing a party wall, said method comprising the steps of: installing a first wall according to fourth aspect; providing a second guide rail on the floor parallel to the guide rail; and installing a second wall on the second guide rail.

The method may comprise the steps of installing insulation between the first and second walls; and securing each wall to a central deflection profile against which each wall is braced. Further steps may include: securing each wall to a soffit using a deflection profile; and sealing any gaps between the walls and the floor or the soffit using intumescent fire sealant.

Embodiments of the aspects may comprise any element of any embodiment of the other aspects of the invention.

BRIEF DESCRIPTION OF THE FIGURES

The invention is described in further detail below by way of example and with reference to the accompanying drawings, in which.

Figure 1:
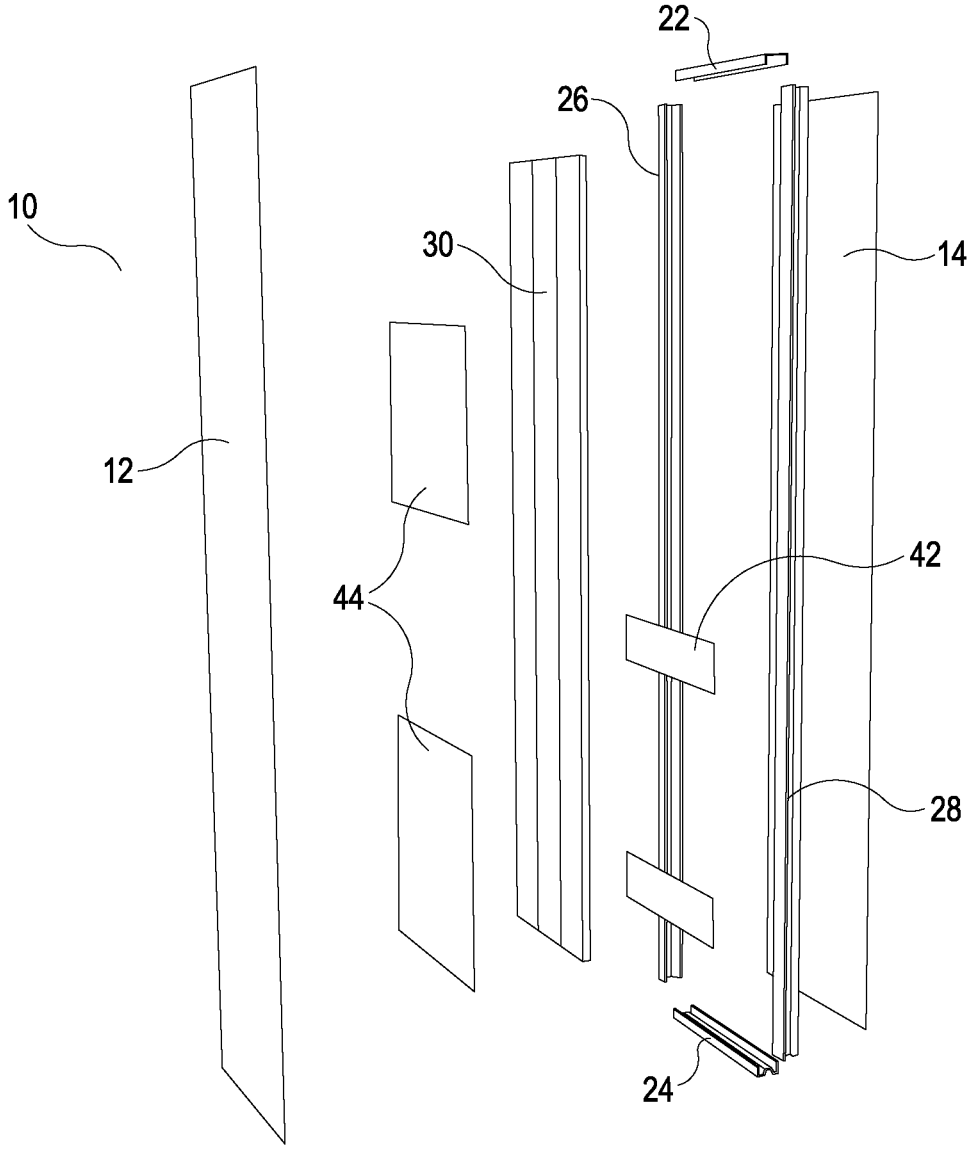
FIG. 1 shows an exploded view of a prefabricated internal wall panel for use with a system according to an embodiment of the present invention.

It should be noted that the Figures are diagrammatic and not drawn to scale. Relative dimensions and proportions of parts of the Figures have been shown exaggerated or reduced in size, for the sake of clarity and convenience in the drawings. The same reference signs are generally used to refer to corresponding or similar feature in modified and different embodiments.

DETAILED DESCRIPTION

FIG. 1 shows an exploded view of a prefabricated internal wall panel 10 according to an embodiment of the present invention. The panel broadly comprises a front gypsum based board 12, rear gypsum based board 14, head track 22 and base track 24. The front board 12 forms an internal face of a room and can be finished accordingly. However, it is typically supplied as a plasterboard finish ready for decorating.

The front board is spaced away from the rear board. The rear board may either form a corresponding internal wall, or may form part of a party wall as will be described below. The rear board is also typically plasterboard, or may be an alternative backboard surface such as cardboard or the like when the panel is used as a party wall, depending on the intended finish or use of the panel.

The front and back boards are connected to a head track 22 and a base track 24 and side studs 26 and 28 such that it provides a void or cavity therebetween. It can be appreciated that this cavity within the panel may be filled with an insulation product, such as Rockwool insulation slabs, or the like.

In the embodiment shown, the panel is an internal wall panel such that the front board and the rear board are gypsum based boards and form an internal face of a room. When used as a party wall, the rear board does not need to be gypsum based and can be cardboard as described above. In a party wall arrangement two panels may be arranged side by side, separated by a void that can be filled with insulation. Each panel is sealed to the floor and a soffit using intumescent fire sealant to provide resistance to fire to prevent fire from spreading from one dwelling or one side of the internal wall to the other dwelling or other side of the internal wall. This also acts to improve the acoustic properties of the panel.

Figure 2A:
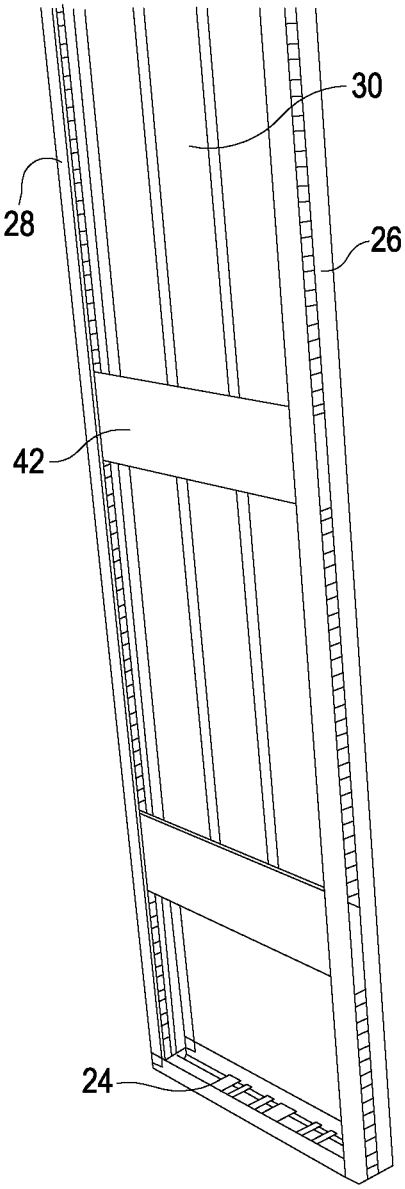
FIG. 2*a* shows the wall panel of FIG. 1 when connected but with the front and rear board removed.
Figure 2B:
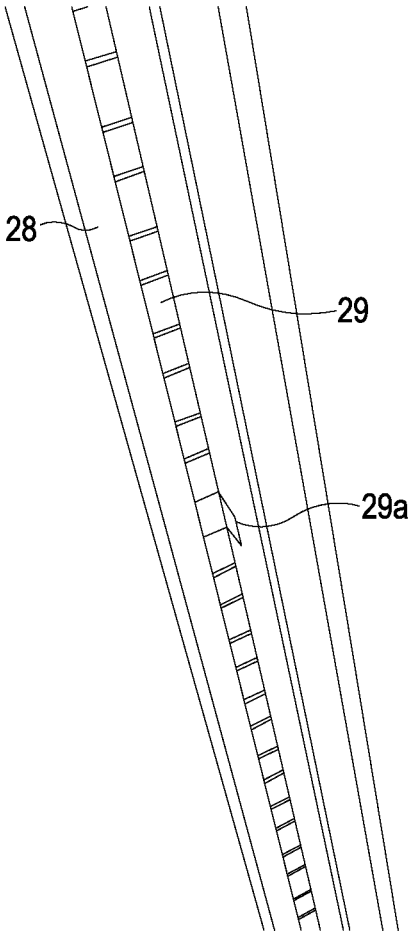
FIG. 2*b* shows a close-up view of side studs of FIG. 2*a* FIG. 2*c* shows a close-up view of the top of the wireway shown in FIG. 2*a;*
Figure 2C:
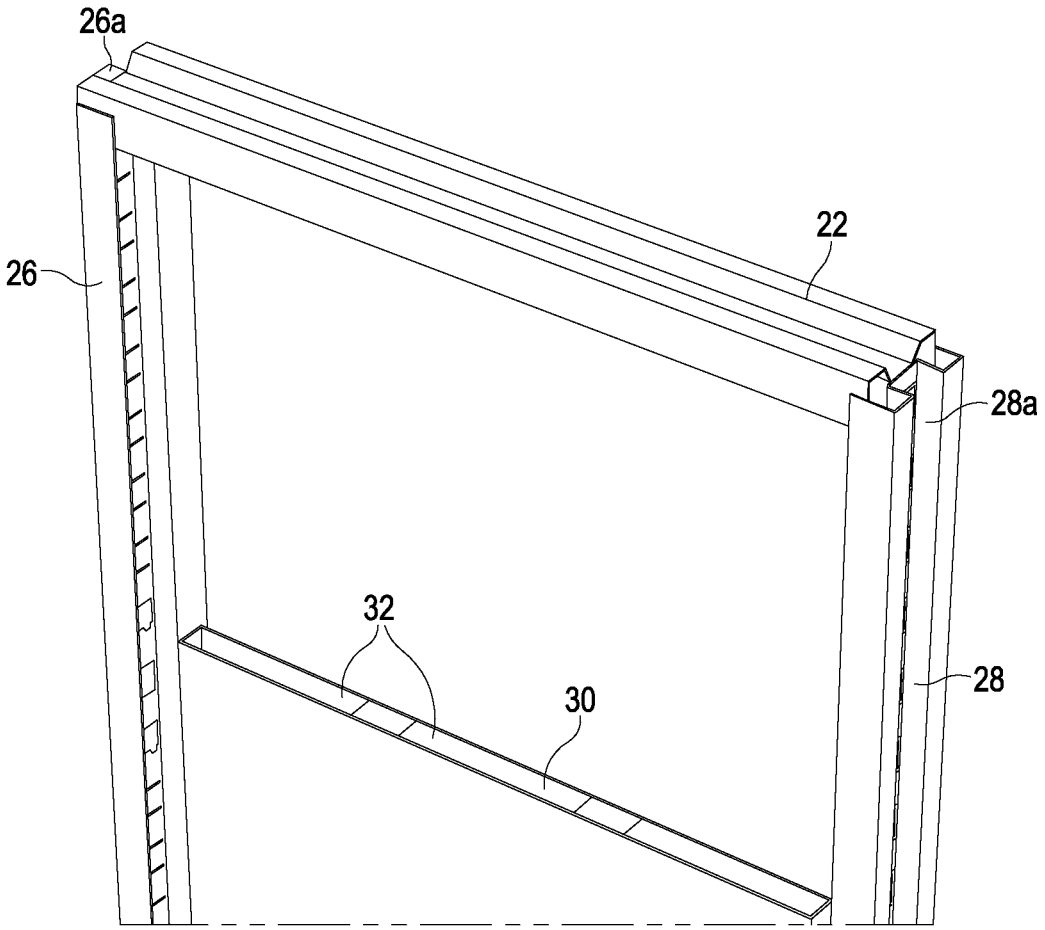

Side studs 26 and 28 are provided, said side studs are shown in greater detail in FIG. 2*c*. The side studs receive the head track 22 and the base track 24 to form a frame for the wall panel. The head track, base track and the side studs are typically metal, generally formed from sheet steel or aluminium. This forms a metal framework around the panel, which provides further fire resistance and again improves the acoustic properties of the panel.

In addition, a wireway 30 is provided that is provided within the cavity behind the front gypsum based board 12, although it can be appreciated that a similar wireway may be provided within the cavity behind the rear gypsum based board 14 when the panel is used as an internal wall. The wireway 30 runs along the height of the front board from a lower point adjacent to the base track to an upper point adjacent to the head track. The wireway typically comprises a number of channels or passages through which cabling for services can be passed therethrough. In the example shown, 3 passages are used, each running parallel to each other. The wireway is typically made of cardboard or the like to provide some degree of structural rigidity and resistance to piercing by the cables. In some embodiments the cardboard may be treated to be smooth with a lower coefficient of friction to aid passage of the cables through the channels.

Also shown in FIG. 1 are support rails 42 that are attached to the side studs and support the wireway 30. The support rails further act to support service backboxes and the like that are placed within the panel. Similarly pattress plates 44 may be provided in front of the wireway between the wireway and the front board to support fixtures and fittings such as TV wall frames or the like.

FIG. 2*a* is a schematic rear view and representation of an assembled wall panel, with the rear board removed. The wireway 30 is shown, supported on support rails 42 that are secured to the side studs 26, 28. The side studs 26, 28 are typically formed of folded metal, such as plate steel or aluminium or the like. As is further shown in FIG. 2*b*, the side struts has a series of pressed tabs 29 that face inwardly towards the cavity. The pressed tab 29*a* is shown in a folded out position to form a fixing point against which the support rails 42 can be fixed. In the example shown in FIG. 2*a*, each support rail 42 forms a brace against which the wireway 30 can be secured. By providing a series of tabs 29 along the length of the side studs 26, 28 the support rail 42 can be secured at any position along the height of the panel.

FIG. 2*c* shows a top portion of the wall panel 10. The side stud 26, 28 are secured by the head track 22 that brace to form a top part of the frame. The head track 22 is typically of metal construction and comprises a channel 23 configured to engage with a guide rail 65 as described below. The head track 22 in an embodiment is the same as the base track 24. This allows the panel to be inverted as required, which aids installation. As shown, the wireway 30 is secured in slots or grooves that run along the side struts. One side stud 26 has a male engagement portion 26*a*, which is configured to be received by a correspondingly shaped female engagement portion 28*a* in the opposite side stud 28. This allows the wall panel to be aligned against a corresponding adjacent wall panel to form a wall. The interlocking of the male and female engagement portions act to secure the wall against lateral movement. The interlocking is typically a friction-fit.

Also shown in FIG. 2*c* are channels or passage 32 in the wireway. The wireway channels 32 run along the length of the wireway 30 and therefore along a substantial portion of the panel. Each channel 32 provides a separate passageway in which service cabling can run and be constrained. The wireway is typically formed of cardboard or the like, that is lightweight and substantially rigid enough to constrain fed cabling. The cardboard also acts to resist piercing through the channels to prevent the cabling being lost in the void. The cardboard may also be substantially smooth (such as with a coating) that acts to reduce friction between cabling and assist in passing cabling through the channels and from a top portion of the panel to a lower part of the panel.

Figure 3A:
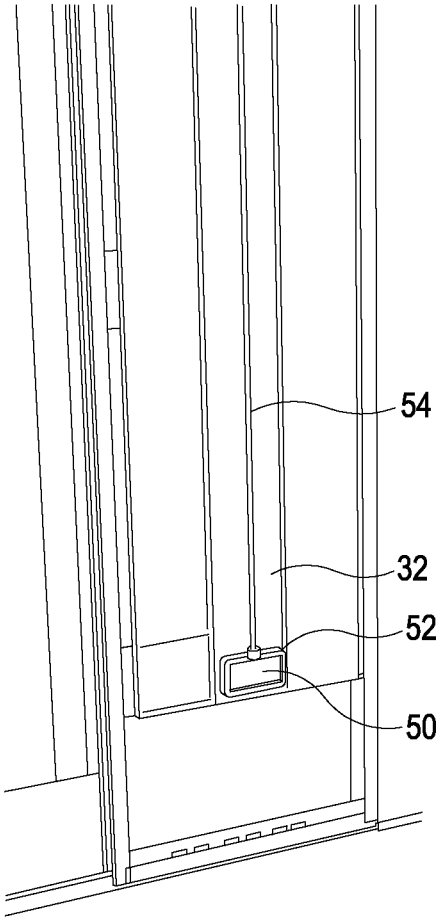
FIG. 3*a* shows a lower portion of the wall panel of FIG. 1 with the front board removed and with a back box connected.

FIG. 3*a* shows the panel in use. A cutaway 50 has been made or chased out in the panel, through the plasterboard surface of the front board and through the cardboard of the wireway. As can be seen, the cutaway can be confined to a single channel, which the tradesperson knows lies within this broad location within the panel. A backbox 52 has been installed in the cutaway and a service cable 54 running through the channel. The service block is secured to the support rail 42 to provide structural rigidity.

Figure 3B:
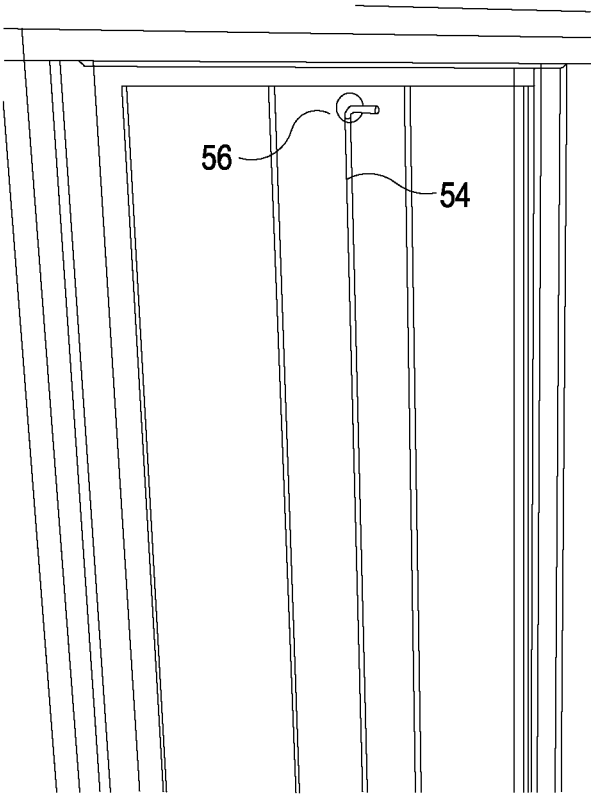
FIG. 3*b* shows an upper portion of the wall panel of FIG. 3*a*.

The service cable 54 is fed through to the service block 52 through an opening 56 in the top portion of the panel as shown in FIG. 3*b*. The opening is either cut or chased through the panel and the wireway into the channel and provides an entry point at which the cabling can be fed to the backbox 52. FIG. 4 shows how services pass through walls. Typically panel 12*a* is installed, and where openings are required a shorter prefabricated panel 12*b* is formed and positioned, then a prefabricated opening panel 60 is installed. This panel 60 is formed to the correct size appropriate to services passing through with the gypsum based boards cut out 62. The next typical panel 12*c* can then be installed and the deflection head profile 64 is then installed at the head. Deflection profiles 64 are fixed to the soffit above which hold the panel in position whilst allowing for deflection in the building and maintaining acoustic and fire resistance performance.

Given the provision of a prefabricated wall panel having the wireway, internal walls can be assembled easily be an installation team, rather than being constructed on site. This reduces the time taken on site and the number of people required on site.

Figure 4A:
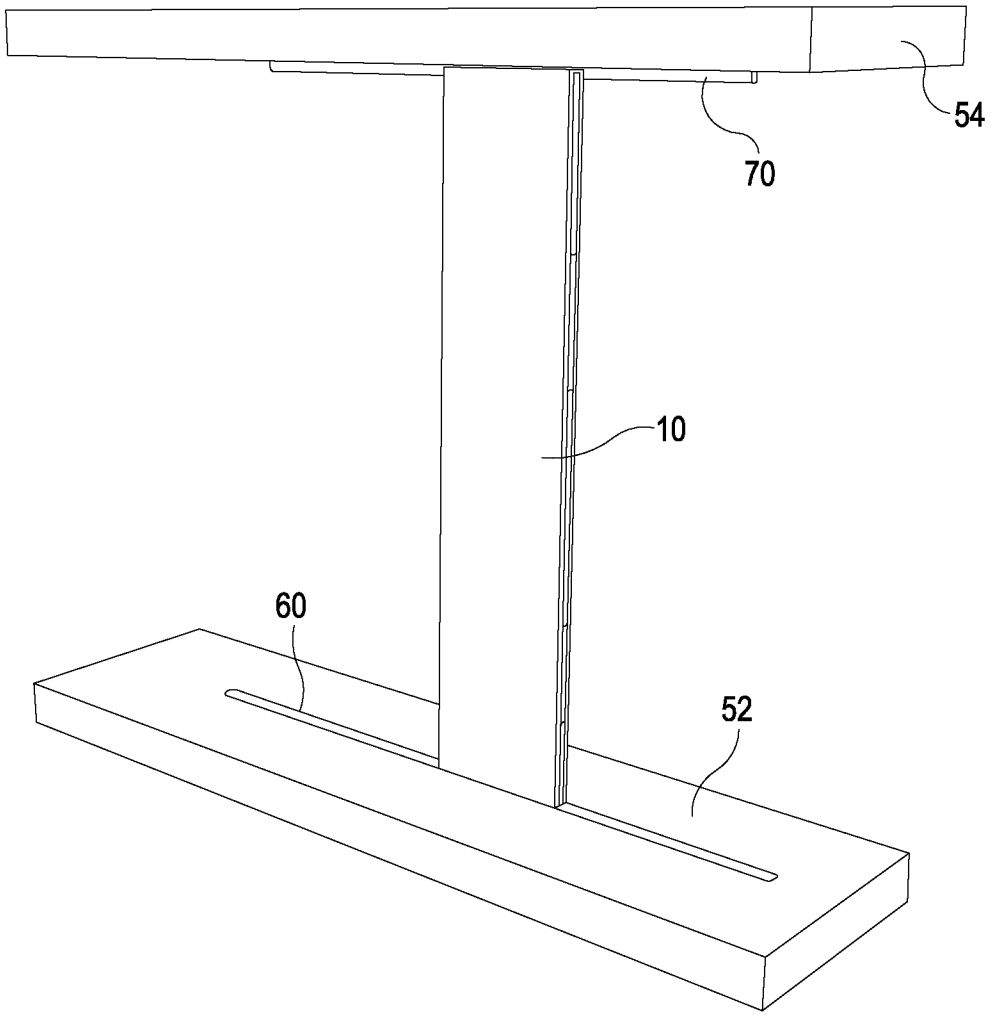
FIG. 4 shows an upper portion of an installed system.

FIG. 4*a* shows the system with a panel installed. In the example shown, the system is installed between a floor 52 and a soffit 54. The panel 10 is aligned on a guide rail 60 installed on the floor 52. A deflection head rail profile 70 is used against which the panel 10 is installed.

Figure 4B:
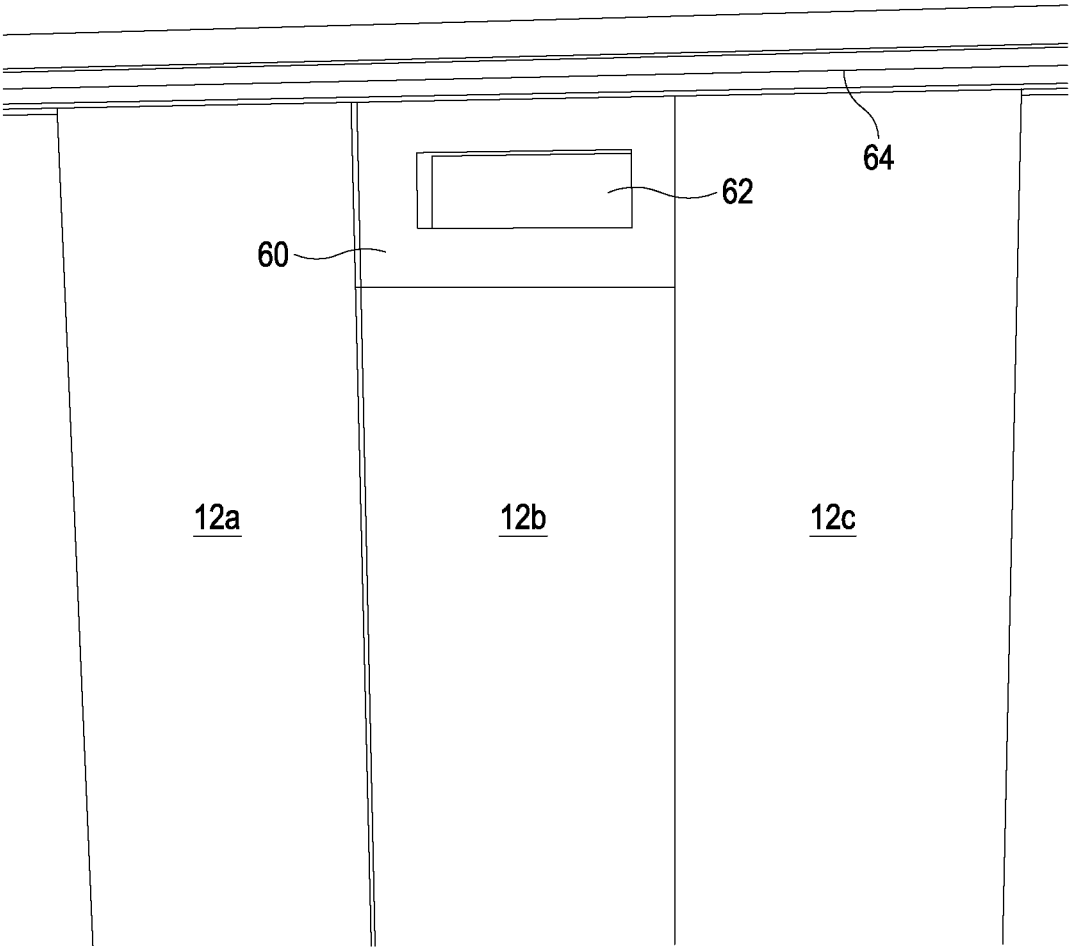

FIG. 4*b* shows an internal wall with four panels—front boards 12*a*, 12*b* and 12*c* form an internal wall surface. Panel 12*b* is shorter and allows for a service opening panel 60 to be installed. Typically panel 12*a* is installed, and where openings are required a shorter prefabricated panel 12*b* is formed and positioned, then a prefabricated opening panel 60 is installed. This panel 60 is formed to the correct size appropriate to services passing through with the gypsum based boards cut out 62. The next panel 12*c* can then be installed and the deflection head rail 70 is then installed at the head to secure all panels into position.

One or more cutaways 62 may then be made through said front board 60 and one or more cutouts can be made for backboxes in said wireways. As noted above, advantageously the cutaway is located solely within one channel. A backbox may then be installed within said cutaway, secured to the support rail. Services cabling may then be fed through the one channel to the backbox through an opening in a top portion of the front board, which may be made by the services installer.

Figure 5:
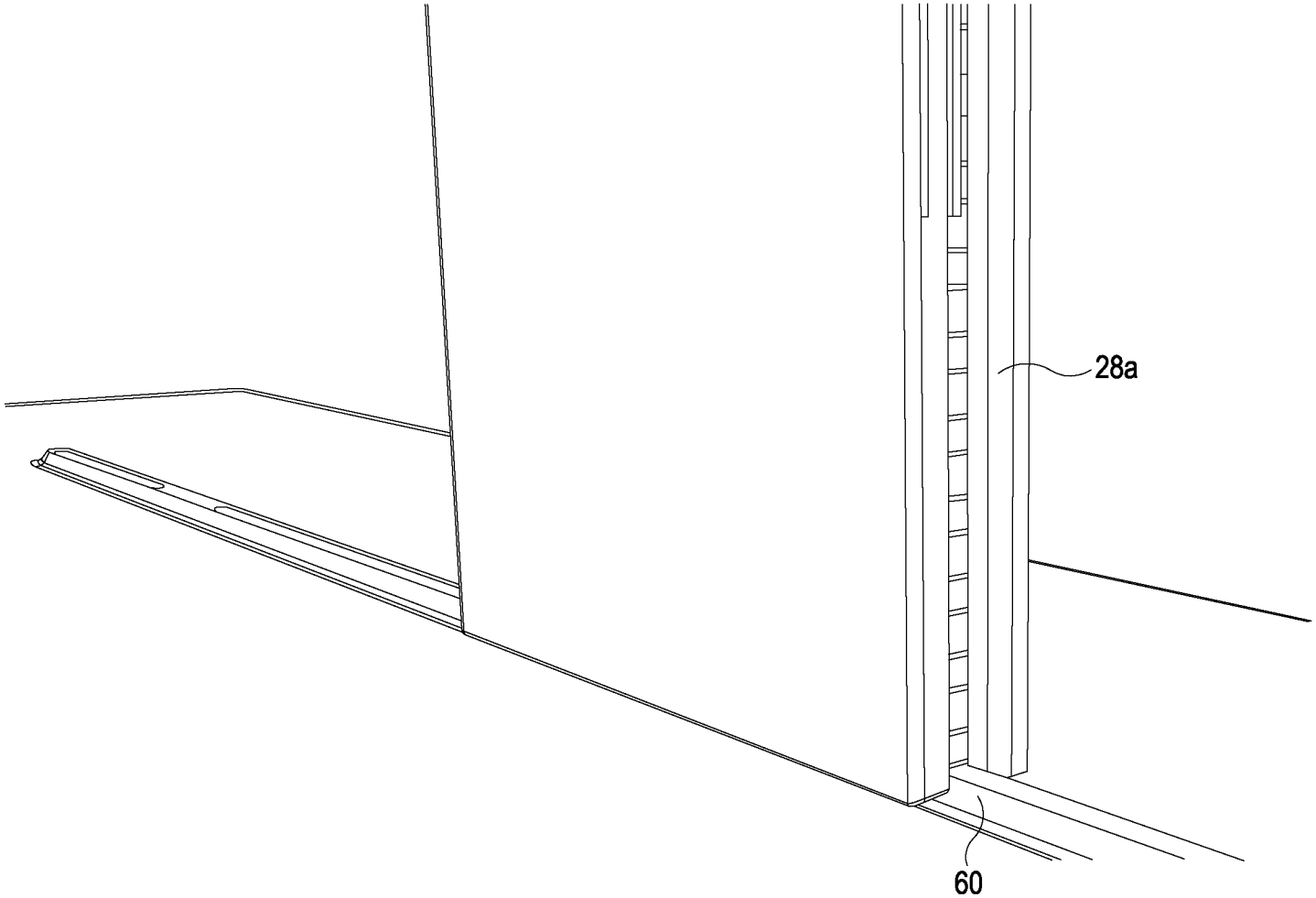
FIG. 5 shows a bottom portion of the wall panel.

FIG. 5 shows the lower section of the installed system of FIG. 3. The female profile of the side stud 28*a* is shown. Also shown is the guide rail 60. The guide rail has a substantially frustoconical or trapezoidal cross-section that runs along the length of the guide rail. This provides a protruding substantially trapezoidal (isosceles trapezoid) raised surface that is configured to be received within a correspondingly shaped recess in the base track 24.

Figure 6A:
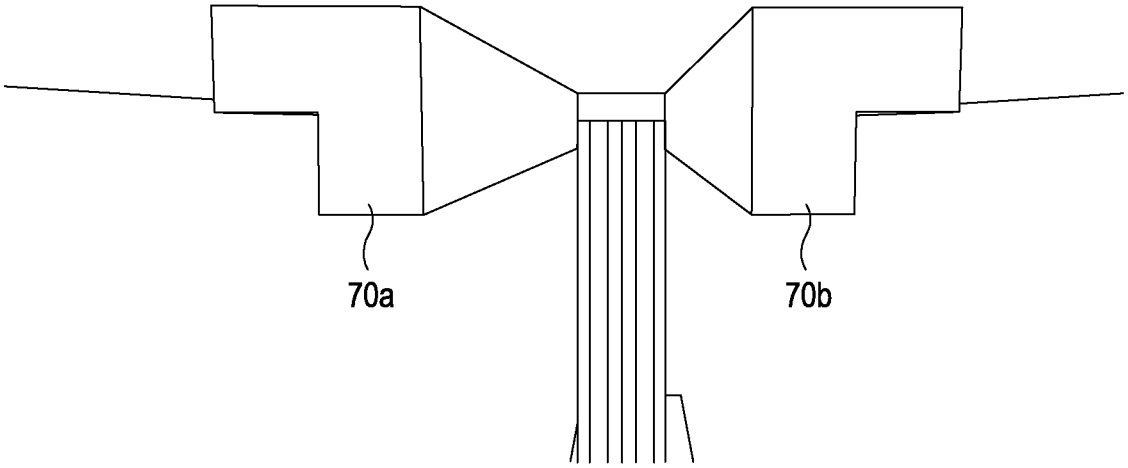
FIG. 6*a* shows a top portion of the wall panel.
Figure 6B:
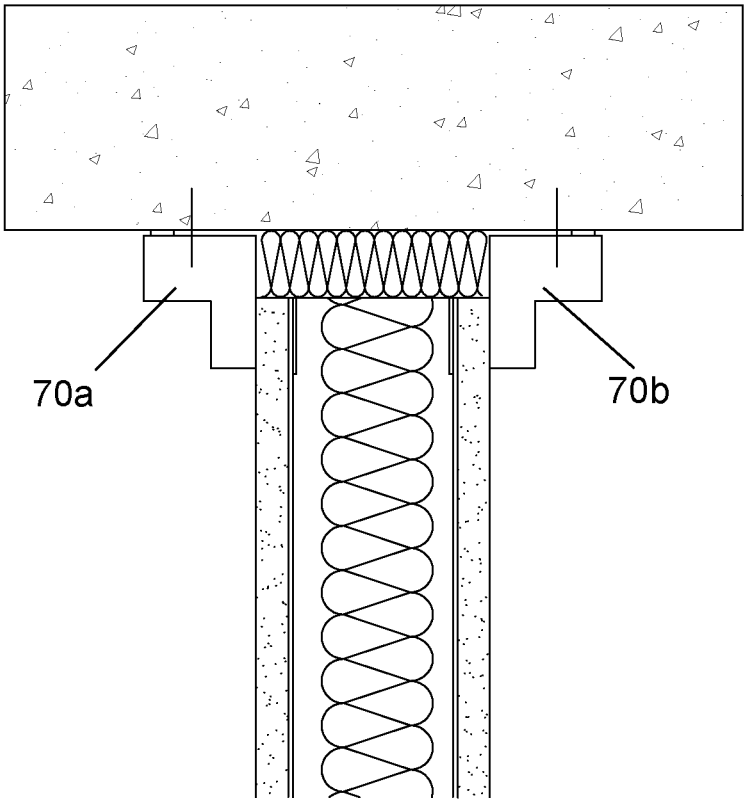
FIG. 6*b* shows a cross sectional view of FIG. 6*a;*

FIG. 6*a* shows the corresponding top section of the installed system of FIG. 3. The panel is secured by deflection profile head rails 70*a*, 70*b*. The deflection profile head rails 70*a*, 70*b* provide rigidity to system and further add to the overall fire resistance of the system. The head rails 70*a*, 70*b* also act to provide acoustic sealing for the panels and the overall system. FIG. 6*b* shows a cross-section, with insulation provided within the cavity of the panel between the front and rear panels, and also above the panels behind the head rails 70*a*, 70*b*.

Figure 7:
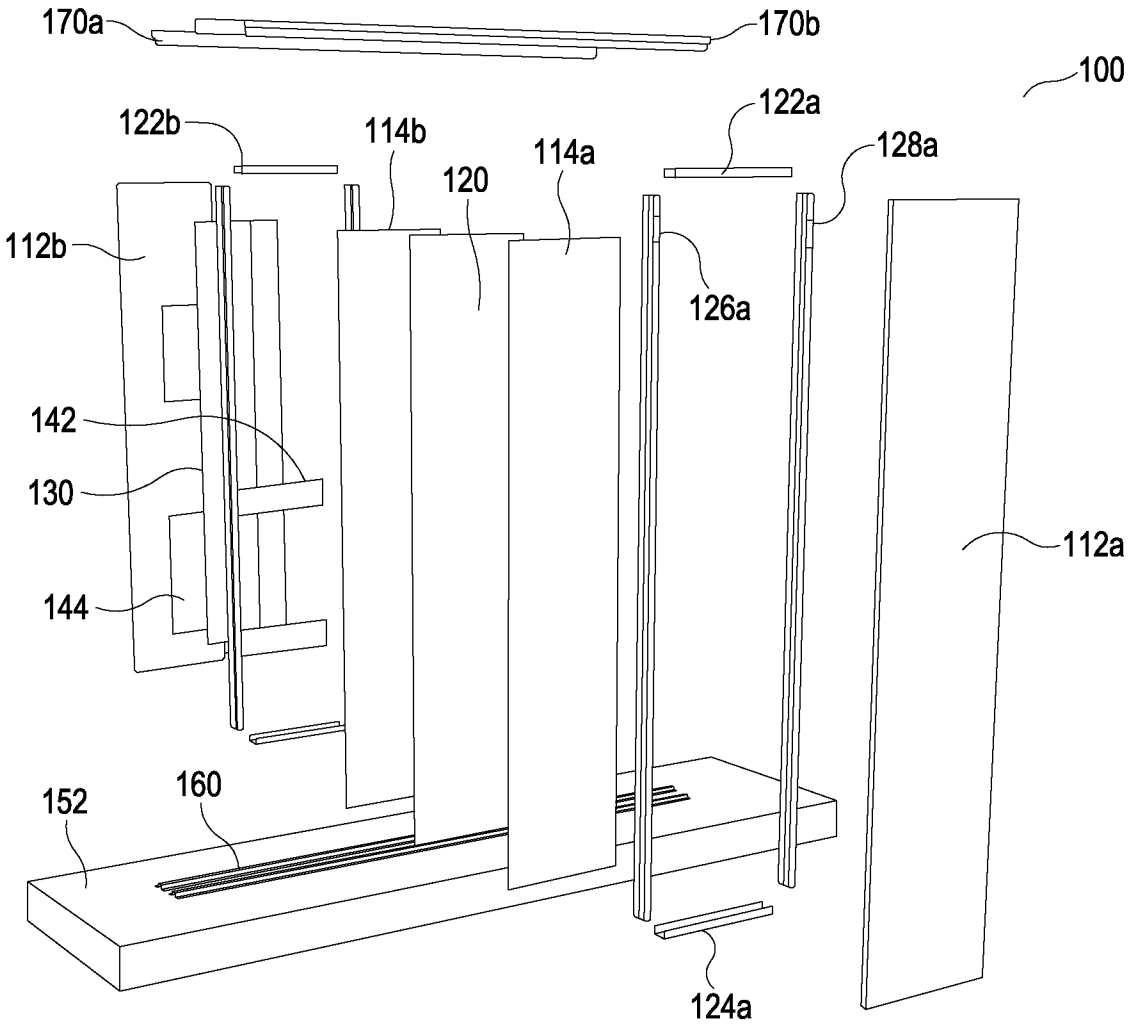
FIG. 7 shows an exploded view of the system used for a party wall.

FIG. 7 shows an exploded view of the system as applied to a party wall 100. As shown, the party wall system is made from 2 party wall panels 100 and comprises front board 112*a*, 112*b* that form internal faces for adjacent walls on either side of the party wall system 100. The system 100 further comprises rear panels 114*a*, 114*b*. Given these are not providing a finished wall face to a room then these can be a lightweight material, such as cardboard liners 114*a*, 114*b*. The use of cardboard provides structural rigidity without the weight of gypsum or metal. The rear boards 114*a*, 114*b* and corresponding front board 112*a*, 112*b* for cavity panels as described above. In the party wall system there is further provided head tracks 122*a*, 122*b* and base tracks 124*a*, 124*b*. Corresponding side struts 126*a*, 128*a*, 126*b*, 128*b* are also shown.

In the party wall system shown, a wireway 130 is shown, together with steel support plates 142 and pattresses 144. These elements are only shown on one side of the party wall—the other side is a panel wall without such wireway.

Figure 8:
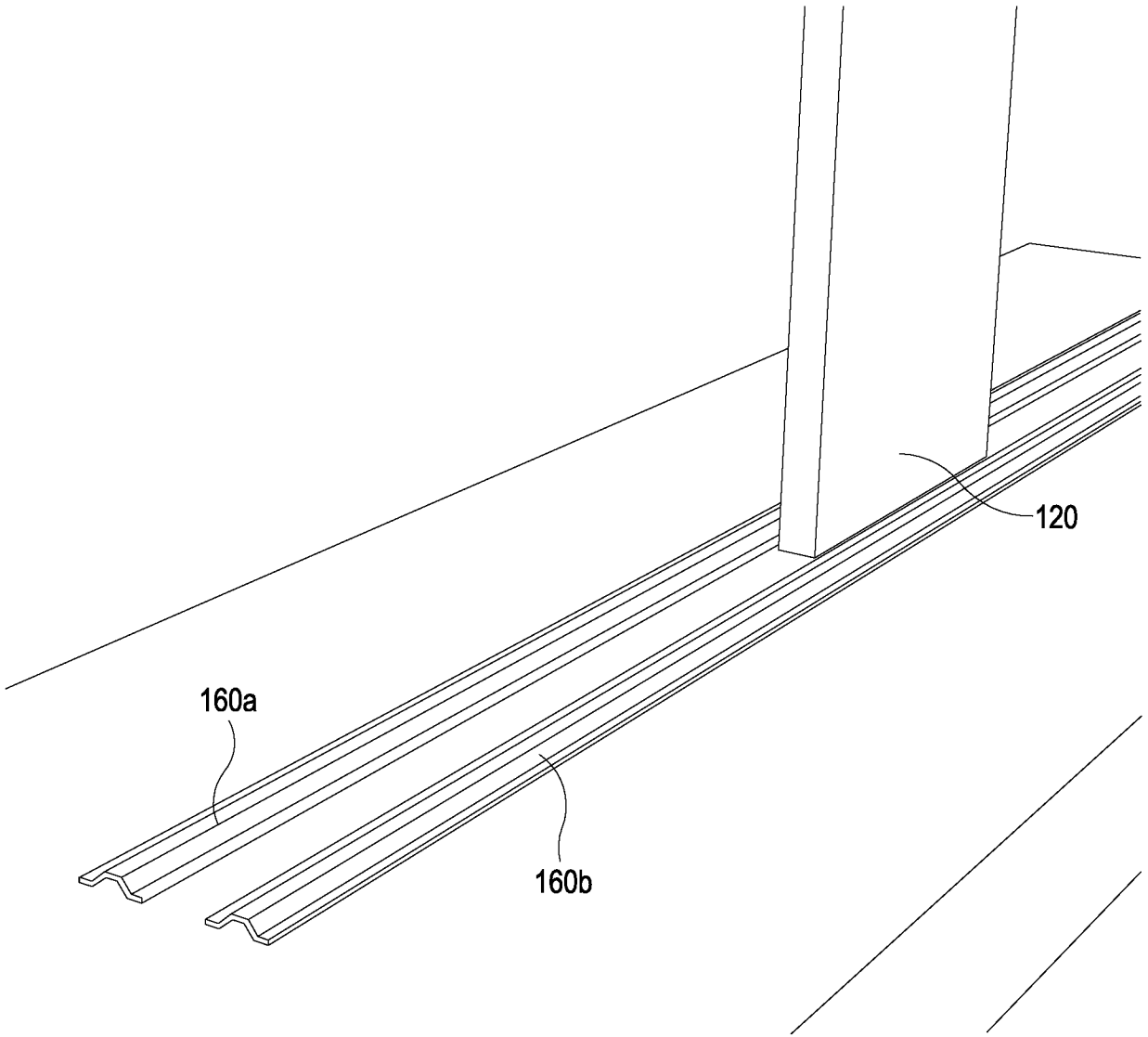
FIG. 8 shows a lower portion of the mounting system used for the party wall.

As can be seen, the 2 party wall panels lie adjacent to each other on either side of an insulation slab 120 that sits between the two wall panels. The front boards face away from each other to form opposing internal walls. A mounting system 160 provided on floor 152 is used to mount the panels. An example is shown in FIG. 8. Similarly, deflection profiles 170*a*, 170*b* are also provided and are shown in more detail in FIG. 9.

FIG. 8 shows an exemplary mounting system 160 which in the present embodiment comprises two parallel guide rails 160*a*, 160*b* separated by an insulation slab 120. The slab may be rockwool insulation or the like. It can be appreciated that the guide rails 160*a*, 160*b* may be a unitary piece—this ensures that the rails are parallel and eases installation.

Figure 9:
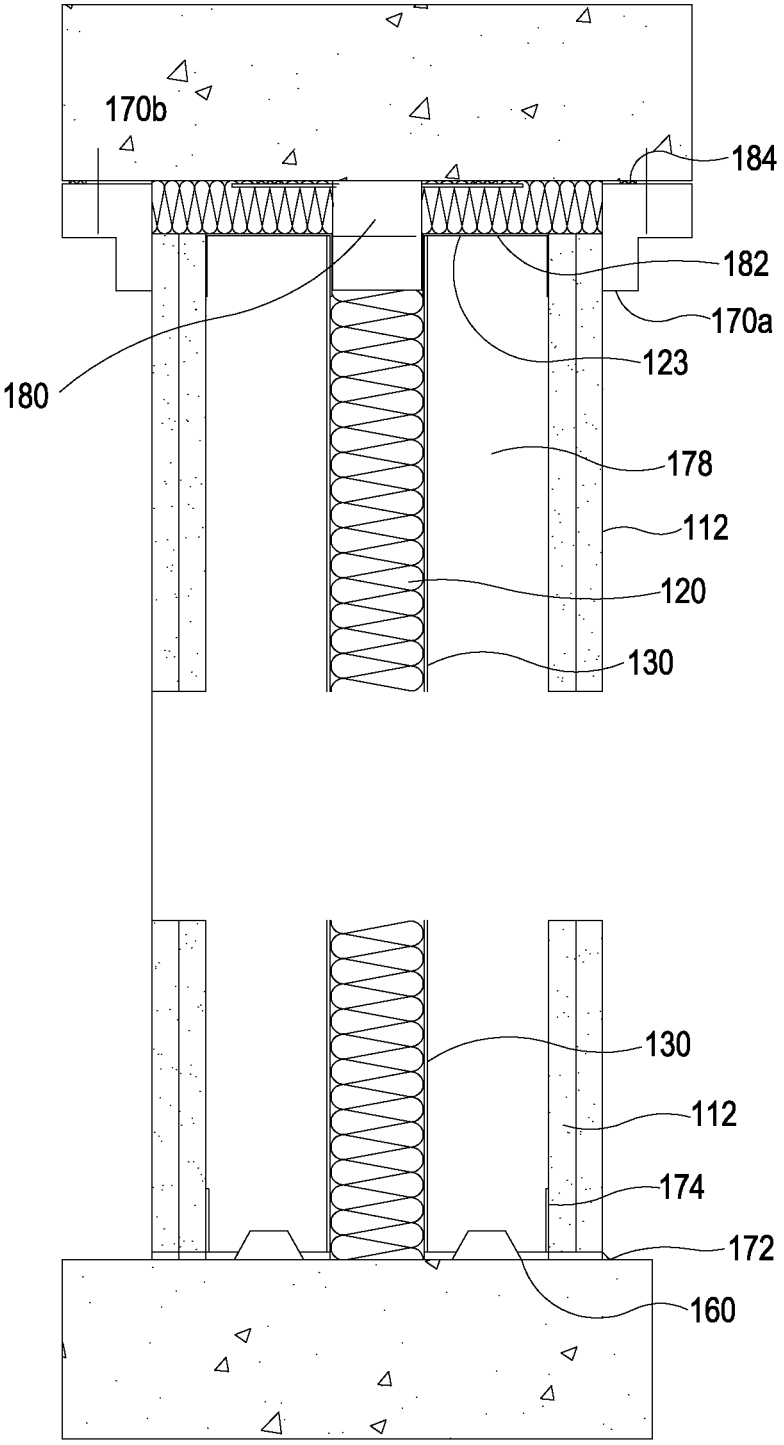
FIG. 9 shows a cross-sectional view of a party wall with the system of FIG. 7.

FIG. 9 shows a cross-section of the party wall system on FIG. 7 after installation (the centre of the system is omitted for clarity). For ease, only one panel is labelled, which in the example shown has two gypsum boards 112 forming the front board. In addition to the elements already described, there is provided a fire sealant 172, such as an intumescent sealant, in the gap between the base of the panel and the floor. This acts to resist fire and smoke ingress through the internal wall by, in the case of an intumescent sealant, expanding when heated to ensure no smoke ingress through the panels and through the party wall. The insulation slab 120 is fitted between the rear board cardboard liners 114 on the back of each panel. The cavity 178 of the panels are filled with acoustic damping material, such as Isover partition roll. This aids in sound proofing the room to prevent sound escape through the party wall.

In addition to the deflection profiles 170*a*, 170*b*, against which the panels are secured, is a central deflection profile 180. This acts to brace the panels and prevent them from moving inward when subject to a lateral force. Final parts of note include insulation 182 within the head strut and intumescent fireproof sealant 184 between the deflection profile 170*a* and the soffit and also between the floor and the guide rails 160 (on the side of the front board 112 at least) to again improve performance in case of fire.

The above described invention provides a prefabricated wall panel system for internal walls that allow walls to be constructed easily with panels interconnected. The system also includes a wireway that aids installation of services, in particular by constraining cabling in defined channels. In this way the cables are more easily fed through the wall panels from a supply in the ceiling to supply boxes at floor level without getting entangled or snagged within the panel. Furthermore, by having cabling within defined channels, the risk to service installers of later service cabling is reduced.

It can be appreciated that the various embodiments described above contain complimentary features that may be combined depending upon the need of the wall installer. Accordingly, the method and systems described herein therefore provide a way of installing an internal wall and a party wall using prefabricated pane Is.

From reading the present disclosure, other variations and modifications will be apparent to the skilled person. Such variations and modifications may involve equivalent and other features which are already known in the art of construction and which may be used instead of, or in addition to, features already described herein.

Although the appended claims are directed to particular combinations of features, it should be understood that the scope of the disclosure of the present invention also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable sub-combination. The applicant hereby gives notice that new claims may be formulated to such features and/or combinations of such features during the prosecution of the present application or of any further application derived therefrom.

For the sake of completeness it is also stated that the term "comprising" does not exclude other elements or steps, the term "a" or "an" does not exclude a plurality, a single panel or other unit may fulfil the functions of several means recited in the claims and reference signs in the claims shall not be construed as limiting the scope of the claims.

What is claimed is:

1. A prefabricated wall panel comprising:

a rear board;

a front board forming an internal face for a room, said front board spaced away from said rear board to form a cavity; and a first side stud and a second side stud, each side stud connected to the front and rear boards on opposing sides of the cavity; and a wireway disposed within the cavity, wherein the wireway runs substantially from a base of the wall panel to a top of the wall panel to allow services to pass through the panel, and wherein the wireway constrains cabling of the services therein; and one or more steel support rails connected across said side studs and between the rear board and the wireway for supporting the wireway, wherein the first side stud comprises a male mating means and the second side stud comprises a female mating means such that the prefabricated wall panel is configured to mate with an adjacent prefabricated wall panel to form a continuous internal wall surface;

wherein the side studs comprise a plurality of tabs, said tabs extendable away from the side studs into the cavity and providing a fixing point for the support rails.

2. The panel of claim 1, wherein the wireway comprises one or more channels that run substantially through the wireway.

3. The panel of claim 1, wherein the side studs comprise a metal profile, and wherein the tabs are punched into the profile.

4. The panel of claim 3, wherein the tabs are configured to fold away from the profile to provide the fixing point.

5. A prefabricated wall system for creating internal building walls, said system comprising:

one or more prefabricated wall panels, each panel comprising:

a rear board;

a front board forming an internal face for a room, said front board spaced away from said rear board to form a cavity; and a first side stud and a second side stud, each side stud connected to the front and rear boards on opposing sides of the cavity; and a wireway disposed within the cavity, wherein the wireway runs substantially from a base of the wall panels to a top of the wall panels to allow services to pass through the panels, and wherein the wireway constrains cabling of the services therein; and one or more steel support rails connected across said side studs and between the rear board and the wireway for supporting the wireway, wherein the first side stud comprises a male mating means and the second side stud comprises a female mating means such that each prefabricated wall panel is configured to mate with an adjacent said prefabricated wall panel to form a continuous internal wall surface;

wherein the side studs comprise a plurality of tabs, said tabs extendable away from the side studs into the cavity and providing a fixing point for the support rails; and a guide rail provided on a floor of a building, wherein said guide rail comprises a raised profile configured to be received within a correspondingly shaped recessed portion in a base track of the panels.

6. The system of claim 5, wherein multiple panels are provided, each panel secured to an adjacent said panel via the mating means and received in the guide rail.

7. The system of claim 5, wherein the front board sits in front of the side studs and tracks to hide the side studs and tracks behind the front board.

8. The system of claim 5, wherein the raised portion comprises a substantially frustoconical cross-section, said raised portion provided along a length of the guide rail.

9. The system of claim 8, wherein the recessed portion extends less than a height of the raised portion, such that a gap is formed between the wall panels and the floor when the recessed portion receives the raised portion.

10. The system of claim 5, wherein first and second wall panels are arranged parallel to each other on separate guide rails to form a party wall.

11. The system of claim 10, wherein an insulated sheet is provided between the guide rails to lie between the first wall panel and the second wall panel.

12. A method for installing services in a prefabricated wall panel, said method comprising the steps of:

forming a wall comprising at least two prefabricated wall panels, each wall panel comprising:

a rear board;

a front board forming an internal face for a room, said front board spaced away from said rear board to form a cavity; and a first side stud and a second side stud, each side stud connected to the front and rear boards on opposing sides of the cavity; and a wireway disposed within the cavity, wherein the wireway runs substantially from a base of the wall panels to a top of the wall panels to allow services to pass through the panels, and wherein the wireway constrains cabling of the services therein; and one or more steel support rails connected across said side studs and between the rear board and the wireway for supporting the wireway, wherein the side studs comprise a plurality of tabs, said tabs extendable away from the side studs into the cavity and providing a fixing point for the support rails;

wherein the first side stud comprises a male mating means and the second side stud comprises a female mating means such that each prefabricated wall panel is configured to mate with an adjacent said prefabricated wall panel to form a continuous internal wall surface, said wall panels mated together to form a unitary wall;

creating a cutaway through said front board of at least one of said panels to access the wireway therein, said cutaway located solely within the wireway;

installing a backbox within said cutaway; and feeding said services cabling through one channel to the backbox through an opening in a top portion of the front board.

* * * * *